United States Patent [19]

Yoshida et al.

[11] Patent Number: 4,458,732

[45] Date of Patent: Jul. 10, 1984

[54] APPARATUS FOR INSERTING A WEFT INTO A SHED BY JETTING FLUIDS IN A JET LOOM

[75] Inventors: Kazunori Yoshida, Nagoya; Susumu Kawabata, Aichi; Fuzio Suzuki, Toyota; Yoshikatsu Kisanuki, Nagoya, all of Japan

[73] Assignee: Kabushiki Kaisha Toyota Chuo Kenkyusho, Aichi, Japan

[21] Appl. No.: 545,584

[22] Filed: Oct. 25, 1983

Related U.S. Application Data

[63] Continuation of Ser. No. 285,499, Jul. 21, 1981, abandoned.

[51] Int. Cl.[3] ..... D03D 47/30

[52] U.S. Cl. ..... 139/435

[58] Field of Search ..... 139/435, 188; 226/97

[56] References Cited

U.S. PATENT DOCUMENTS

| | | | |
|---|---|---|---|
| 4,244,402 | 1/1981 | Hasegawa et al. | 139/435 |
| 4,290,460 | 9/1981 | Deborde | 139/435 |
| 4,314,590 | 2/1982 | Suzuki et al. | 139/435 |

FOREIGN PATENT DOCUMENTS

| | | | |
|---|---|---|---|
| 2031958 | 4/1980 | United Kingdom | 139/435 |

*Primary Examiner*—Henry Jaudon

*Attorney, Agent, or Firm*—Berman, Aisenberg & Platt

[57] ABSTRACT

An apparatus for inserting a weft into a shed by jetting fluids in a jet loom comprises a plurality of thin plate-like members arranged in alignment in the direction of weft insertion on a sley, each of the thin plate-like members being provided with an opening in the same position of each of said thin plate-like members to form a guiding channel, and nozzle means for jetting fluids through the guiding channel. Each of the thin plate-like members is provided with at least one cavity which is formed adjacent the circumference of each of the openings of the thin plate-like members on a downstream sidewall, in the direction of weft insertion, of the mutually facing sidewalls thereof. Due to the formation of the aforesaid cavity, the amount of the fluid flow escaping through the space between each two adjacent thin plate-like members outside of the guiding channel without narrowing the width of the space therebetween. As a result, the flight of the weft is remarkably stabilized and the flying speed of the weft is increased with reducing the consumption of fluids jetted from nozzle means.

17 Claims, 14 Drawing Figures

APPARATUS FOR INSERTING A WEFT INTO A SHED BY JETTING FLUIDS IN A JET LOOM

This application is a continuation of application Ser. No. 285,499 filed July 21, 1981, now abandoned.

BACKGROUND OF THE INVENTION

1. Field of the Invention

This invention relates to the improvement of an apparatus for inserting a weft into a shed by jetting fluids in a jet loom, more particularly, in an air jet loom in which the compressed air is used as fluids.

2. Description of the Prior Art

In the conventional jet looms, there are known types of apparatus for inserting a weft into a shed by jetting fluids from a main nozzle through a continuous tunnel-like guiding channel for the weft constituted by a plurality of semi-opened type of openings or closed type of openings with a slit as an unthreading passage (hereinafter referred to as, simply, openings for the use as a generical term) each of which is formed in the same position of each of reed blades or guide members mounted, independently of reed blades, on a sley.

In such known jet looms, a jet loom having an apparatus for inserting a weft through a guiding channel formed by a plurality of semi-opened type of openings of reed blades is called a modified reed type of jet loom, and a jet loom having an apparatus for inserting a weft through a guiding channel formed by a plurality of openings of guide members is called a guide member type of jet loom.

Either type of jet loom, i.e., either a modified reed type of jet loom or a guide member type thereof, has the aim in common to insert a weft into a shed in a stable manner which is attained by the following constructions and means; a plurality of thin plate-like members made of a rigid body provided with openings are arranged in alignment at a predetermined space in a width direction of the thin plate-like member. The aligned spaces between the thin plate-like members are penetrated by the warps, and a plurality of openings of the aligned members constitute a guiding channel through which the weft is inserted by jetting fluids from a main nozzle and, if need arises, a plurality of auxiliary nozzles in addition, with the result that the stability of the weft insertion is accomplished.

However, in any apparatus for inserting a weft into a shed by jetting fluids in known jet looms, irrespective of whether it is a modified reed type or a guide member type, a disadvantage of the apparatus resides in the fact that fluids flowing through a guiding channel easily tend to escape from the space between the aligned thin plate-like members outside of the guiding channel, this tendency resulting in the unstability of the weft insertion or an undesired, inevitable increase of the consumption of fluids jetted from the main nozzle and the auxiliary nozzles in compensation for the stability of the weft insertion.

There exists, therefore, a need for an improved apparatus for inserting a weft into a shed by jetting fluids in a jet loom which overcomes the above-mentioned disadvantage involved in the conventional apparatus.

SUMMARY OF THE INVENTION

It is, therefore, a primary object of this invention to provide an apparatus for inserting a weft into a shed by jetting fluids in a jet loom in which the amount of the fluid flow escaping through the space between each two adjacent thin plate-like members is remarkably reduced to increase the flying speed of the weft and to stabilize the flight of the weft without increasing the consumption of fluids jetted from nozzle means.

In accordance with the present invention, the above-mentioned object can be attained by providing an apparatus for inserting a weft into a shed by jetting fluids in a jet loom which comprises a plurality of thin plate-like members arranged in alignment in the direction of weft insertion on a sley, each of the thin plate-like members being provided with an opening in the same position of each of the thin plate-like members to form a guiding channel, and nozzle means for jetting fluids through the guiding channel, wherein each of the thin plate-like members is provided with at least one cavity which is formed adjacent the circumference of each of the openings of the thin plate-like members on a downstream sidewall, in the direction of weft insertion, of the mutually facing sidewalls thereof.

In the apparatus for inserting a weft into a shed by jetting fluids in a jet loom comprising the above-mentioned construction characterized by the present invention, by introducing a fluid flow, which escapes through the space between the mutually facing side walls of each two adjacent reed blades or guide members, to flow along the cavity, the escaping fluid flow is bended so that a cross-sectional area effective for the fluid flow to escape through the space between the mutually facing side walls thereof is narrowed; the length of the passage for the escaping fluid flow is elongated; and that the thus-bended fluid flow imparts a resistance to the fluid flow escaping through the space therebetween, whereby the amount of the escaping fluid flow is reduced. As a result, the present invention is advantageous in the fact that a fluid flow for guiding the weft can be strengthed; the flying speed of the weft can be increased with maintaining a good stability in the weft insertion; and that the consumption of fluids jetted from nozzle means can be reduced.

According to the present invention, if at least one cavity is formed on a downstream side wall, in the direction of weft insertion, i.e., in the direction of the fluids flowing throug a guiding channel, of the mutually facing side walls of each two adjacent reed blades or guide members, the fluid flow escaping through the space between the mutually facing side walls thereof is introduced to flow along the cavity formed on the downstream side wall thereof so that the escaping fluid flow is drawn near to the downstream side wall thereof. Accordingly, a large vortex is formed near the upstream side wall of the mutually facing side walls of each two adjacent reed blades or guide members and a cross-sectional area effective for the fluid flow to escape through the space between the mutually facing side walls thereof is narrowed. As a result, the advantage of the present invention resides in the fact that the amount of the escaping fluid flow is still further reduced.

According to the present invention, since each of reed blades or guide members is provided with a cavity, i.e., a kind of depression, not projection, on at least one side wall of the mutually facing side walls of each two adjacent reed blades or guide members, it is advantageous in that no damage is caused to the warp which get into and out of the space between the mutually facing side walls of each two adjacent reed blades or guide members and that no accumulation of dust and flies is made due to the constant flow of the escaping fluid into the cavity.

BRIEF DESCRIPTION OF THE DRAWINGS

Various other objects, features and attendant advantages of the present invention will be more apparent from the following detailed description when considered in connection with the accompanying drawings in which like reference characters designate like or corresponding parts throughout the several views.

In the drawings.

DETAILED DESCRIPTION OF THE PREFERRED EMBODIMENTS

The invention will now be described with reference to the embodiments shown in the accompanying drawings.

Figure 1:
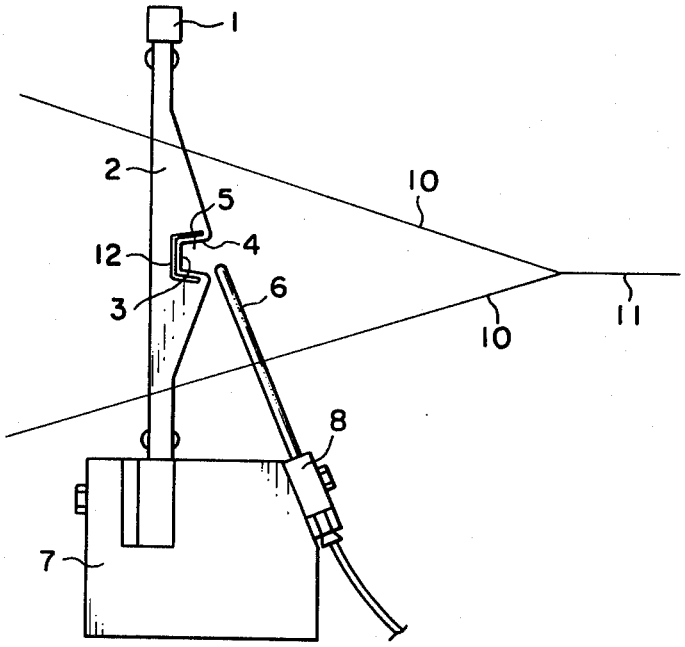
FIG. 1 is a side elevation of one embodiment of the present invention.
Figure 2:
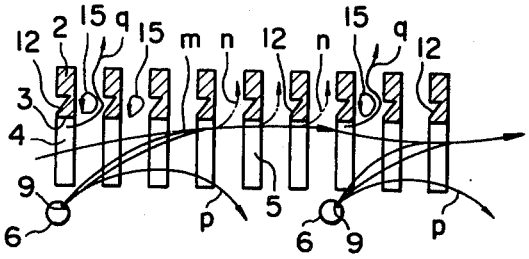
FIG. 2 is an enlarged, cross-sectional view of the principal part of the same embodiment as shown in FIG. 1.

FIG. 1 and FIG. 2 show the embodiment of the present invention applied to the modified reed type of jet loom. Each of a plurality of reed blades 2 constituting a reed 1 has the upper and lower projecting tongues on the cloth-fell side thereof which forwardly extend in the beating-up direction, and, in a substantially mid-position in the vertical direction of each reed blade, is provided with a semi-opened type of a frustum shaped opening 4 having a flat bottom portion 3 defined by the wall face between the mutually facing edges of the upper and lower projecting tongues and being open toward the shed. A plurality of the opening 4 formed in the vertically same position of each of reed blades 2 are arranged in alignment in a width direction of the reed 1 to constitute a guiding channel 5 for the weft.

A number of the auxiliary nozzles 6 are located at a predetermined space and fastened by means of a fixing equipment 8 into a sley 7 into which the root portion of the reed 1 is also fastened. The auxiliary nozzle provided with an aperture 9 is positioned in the proximity of a guiding channel 5 formed by a plurality of openings 4 to be oriented in the desired direction, so far as the thus disposed auxiliary nozzle does not impede a beating-up motion by means of the flat bottom portion 3 of the opening 4 formed in the reed blade.

Each of the warps penetrates through the space between each two adjacent reed blades 2, while the weft is initially inserted into the guiding channel 5 together with a flow of fluids jetted from a main nozzle (not shown) and is carried through the guiding channel in the direction of weft insertion, being subjected to a propelling force by the auxiliary fluids jetted from the aperture 9 of the auxiliary nozzle 6, until the weft reaches the end of the guiding channel. After the completion of the weft insertion, the weft is beaten up to the fabric 11 by means of the flat bottom portion 3 of the opening 4 formed in the reed blade with a swinging movement of a sley 7.

FIG. 2 is a cross-sectional view of a guiding channel 5 shown in FIG. 1 and taken across the substantially center line thereof. As is apparent from FIG. 1 and FIG. 2, the present invention is characterized in that a curved groove 12 as a cavity is formed and elongated along each of the openings 4 at the circumference thereof on a downstream side wall, in the direction of weft insertion, of the mutually facing side wall of each two adjacent reed blades 2.

The curved groove or cavity 12 has a V-shape constituted by two inclined faces having different angles with respect to the side wall of the reed blade 2; one inclined face of the curved groove 12 on the nearer side to the opening 4 intersects with the side wall of the reed blade 2 at a small angle and the other inclined face thereof on the far side from the opening 4 intersects therewith at a large angle.

In FIG. 2, the arrows show the respective flow lines of fluids jetted from a main nozzle and an auxiliary nozzle. Most of fluids, as shown by a line m, flows in the longitudinal direction of the guiding channel at the innermost portion thereof. Part of fluids, as shown by a one-dot broken line n, escapes through the space between each two adjacent reed blades 2 outside of the guiding channel. Part of fluids, as shown by a line p, leakes in the direction toward which the opening 4 is open.

In a modified reed type of jet loom comprising a plurality of reed blades 2 not provided with a curved groove characterized by the present invention, the escape of the fluids as shown by the line n tends to be further increased. This tendency is due to the fact that a vortex 15 formed near the intersection of the edge of the wall of the opening of the reed blade with a upstream side wall, in the direction of weft insertion, of the mutually facing side walls of each two adjacent reed blades is relatively small and unstable. As the fluids to be blown into a guiding channel are initially jetted from a main nozzle at high pressure, a static pressure in the guiding channel exceeds atmospheric pressure. For this reason, the fluids flowing near the wall of the guiding channel formed by the openings of the reed blades separate from the fluid flow m at the edge of the wall thereof between each two adjacent reed blades 2 to form a small vortex 15. However, as the fluid flow in the guiding channel is fluctuated, observed from the microscopical viewpoint, the position and the size of the vortex 15 becomes unstable.

In this embodiment shown in FIG. 1 and FIG. 2, due to the formation of the curved groove 12, the fluid flowing along the curved groove as shown by a line q is positively produced so that the fluid flow escaping through the space between each two adjacent reed blades is drawn near to the downstream side wall, in the direction of weft insertion, of the mutually facing side walls of the reed blades, whereby the vortex 15 is enlarged and strengthened to stabilize the position and the size of the vortex. Due to the stabilized formation of the enlarged and strengthened vortex, a cross-sectional area effective for the fluid to escape through the space between each two adjacent reed blades is narrowed; a resistance imparted to the fluid flow passing through the space thereof is increased by lengthening and complicating the passage for the escaping fluid flow; and the velocity of the escaping fluid flow is diminished to reduce the amount of the escaping fluid flow. As a result, the fluid flow for guiding the weft can be strengthened and the flying speed of the weft can be increased with maintaining a good stability in the weft insertion.

Figure 3:
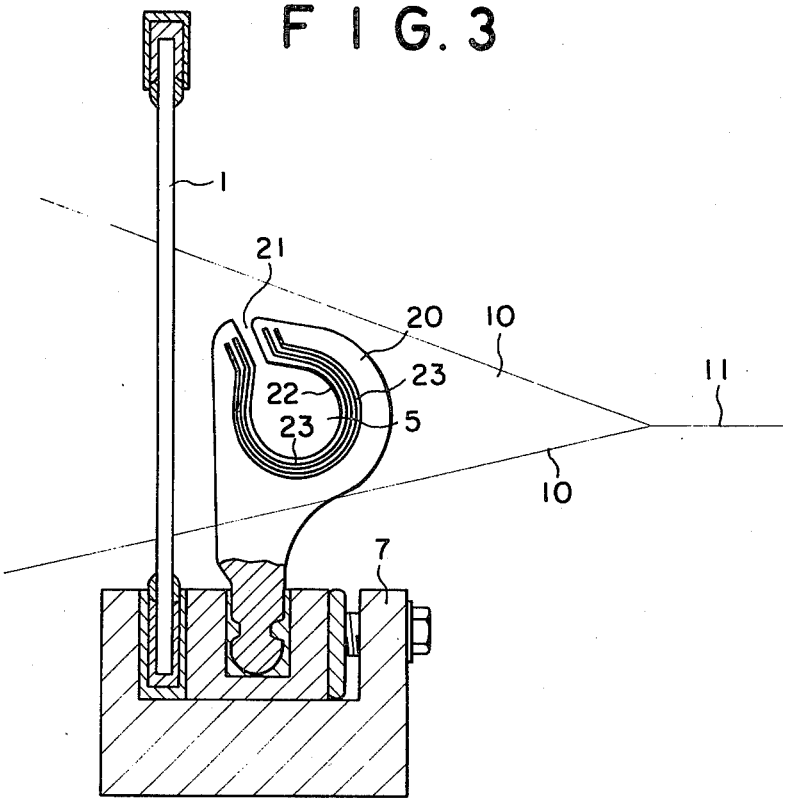
FIG. 3 is a side elevation of another embodiment of the present invention.
Figure 4:
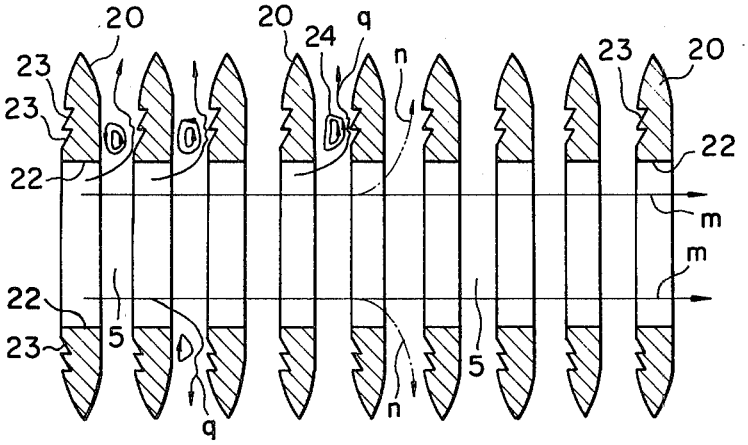
FIG. 4 is an enlarged, cross-sectional view of the principal part of the same embodiment as shown in FIG. 3.

FIG. 3 and FIG. 4 show the embodiment of the present invention applied to the guide member type of jet loom. A plurality of thin plate-like guide members 20, which are independent of a reed 1, are mounted on a sley 7 and are arranged in alignment at a predetermined space in a width direction thereof. Each of guide members 20 is provided with a closed type of a substantially circular shaped opening 22 having a slit 21 as unthreading passage at the upper mid-portion thereof through which the opening 22 is communicated with the outside and a plurality of the openings 22 constitute a guiding chanel 5 for the weft.

The weft is inserted through the guiding channel 5 by jetting fluids from a main nozzle (not shown) in the direction of weft insertion. After the completion of the weft insertion, a plurality of guide members 20 get out of the shed formed between a sheet of the upper warps 10 and a sheet of the lower warps 10 with the swinging movement of the sley 7, while, at the same time, the weft is unthreaded through the slit 21 of the opening 22 and remains in the shed to be beaten up to the fabric 11 by means of the reed 1.

FIG. 4 is an enlarged, cross-sectional view of the guide member 20 shown in FIG. 3 and taken across a substantially center line of the opening 22. As is apparent from FIG. 3 and FIG. 4, the present invention is characterized in that two curved grooves 23 as a cavity are formed and elongated in parallel along each of the openings 22 at the circumference thereof on a downstream side wall, in the direction of weft insertion, of the mutually facing side walls of each two adjacent guide members 20.

As described in the first embodiment shown in FIG. 1 and FIG. 2, the curved groove 23 has a V-shape constituted by two inclined faces having different angles with respect to the side wall of the guide member 20; one inclined face of the curved groove 23 on the nearer side to the opening 22 intersects with the side wall of the guide member at a small angle and the other inclined face thereof on the far side from the opening 22 intersects therewith at a large angle.

In the guide member type of jet loom, the leakage of the fluid flow as shown by a line p in FIG. 2 does not occur. On the other hand, according to the conventional guide member, the amount of the fluid flow escaping through the space between each two adjacent guide members as shown by a one-dot broken line n in FIG. 2 is too large to be neglected for a correct and stable weft insertion. For this reason, the tip part of the weft, during its flight through the guiding channel, is not infrequently caught in between the space of each two adjacent guide members by the escaping fluid flow n. This results in the failure of the weft insertion. Furthermore, the escaping fluid flow results in reduction of the velocity of the fluid flowing through the guiding channel and causes a drop in the operating speed for the weft insertion.

The occurrence of the escaping fluid flow is caused by the same phenomena as explained above in the modified reed type of jet loom. In this embodiment shown in FIG. 3 and FIG. 4, by means of two curved grooves 23 in parallel, a vortex 24 is enlarged and strengthened to stabilize the position and the size of the vortex 24; a cross-sectional area effective for the fluid to escape through the space between each two adjacent guide members is narrowed; a resistance imparted to the escaping fluid flow is still further increased by bending the escaping fluid flow more complicatedly due to the formation of two curved grooves 23 in parallel; the velocity of the escaping fluid flow as shown by a line q is remarkably reduced. As a result, the fluid flow for guiding the weft can be strengthened and the flying speed of the weft can be increased with maintaining a good stability in the weft insertion.

Figure 5:
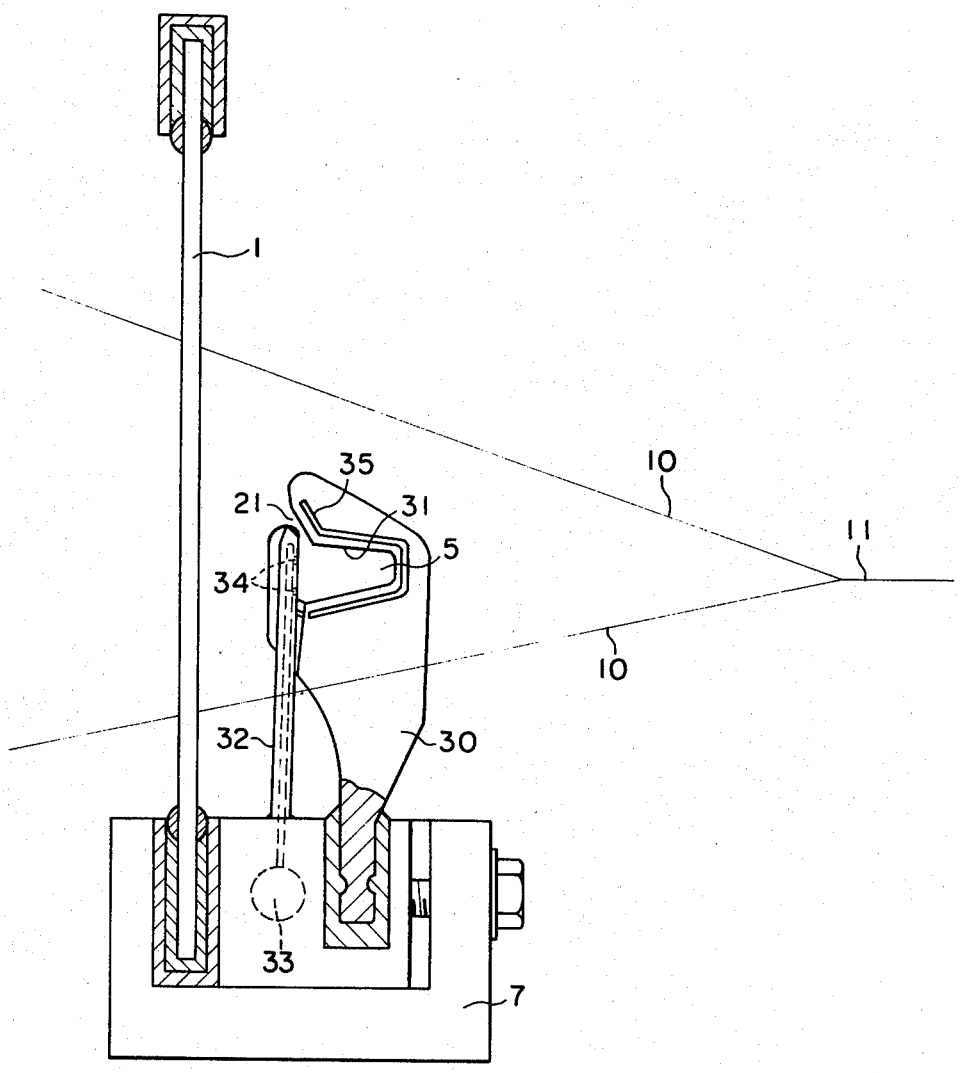
FIG. 5 is a side elevation of other embodiment of the present invention.
Figure 6:
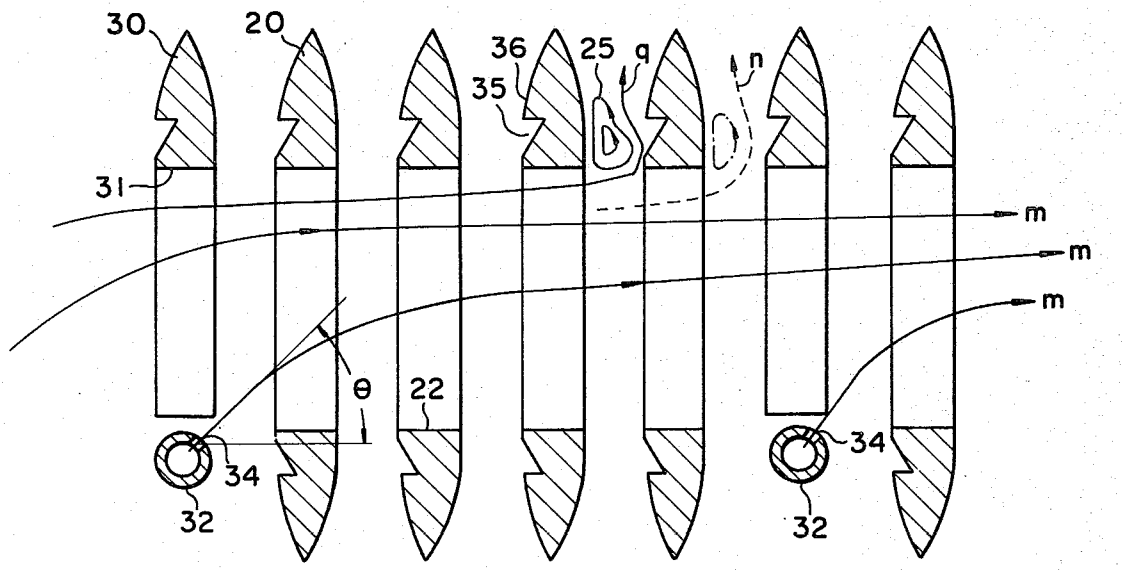
FIG. 6 is an enlarged, cross-sectional view of the principal part of the same embodiment as shown in FIG. 5.

FIG. 5 and FIG. 6 show another embodiment of the present invention applied to the guide member type of jet loom. Referring to FIG. 5, a guiding channel 5 is constituted by a predetermined number of a group which consists of several to dozen guide members 20 provided with a closed type of a frustum shaped opening with a slit 21 as unthreading passage and one modified guide member 30 provided with a semi-opened type of frustum shaped opening 31 being open toward the reed 1 made by cutting the left portion from the slit 21 of the guide member 20. A plurality of auxiliary nozzles 32 are mounted on a sley 7 so as to be connected by the root portion thereof with a fluid passage 33 which leads to a supply sourse of a compressed fluid (not shown), and each of the auxiliary nozzles 32 is positioned so as to confront the opened portion of the opening 31. From a plurality of apertures 34 at the lateral face of each auxiliary nozzle 32, auxiliary fluids are jetted into the guiding channel 5 in the desired direction.

FIG. 6 is a cross-sectional view of the guiding channel 5 formed by a plurality of the guide members shown in FIG. 5 and taken across a substantially center line thereof. In the guide member type of jet loom in this embodiment shown, a weft is drawn near to the innermost wall, remote from a slit 21 as unthreading passage, of each of the openings 31 which form the guiding channel 5, by the auxiliary fluids jetted from the apertures 34 of each auxiliary nozzle 32 and the fluid flow escaping through the space between each two adjacent guide member, whereby the weft, during its flight, can be prevented from getting out to the slit 21.

Therefore, according to known guide member not provided with a curved groove as a cavity characterized by the present invention, the amount of the escaping fluid flow as shown by one-dot broken line n is much larger near the innermost wall of the guiding channel 5, i.e., the bottom portion of each of semi-opened type of frustum shaped openings which form the guiding channel, as compared with the second embodiment of the present invention shown in FIG. 3 and FIG. 4.

The apertures 34 of the auxiliary nozzle 32 are positioned in such a direction that the auxiliary fluids can be jetted into the guiding channel at an angle $\theta$ in the direction of weft insertion. The auxiliary fluids collide against the innermost wall of the guiding channel 5 and, at the same time, mingles into the flow of the fluids jetted from a main nozzle to form a fluid flow m of higher velocity which flows near the innermost wall of the guiding channel in the direction of weft insertion. Near the innermost wall of the guiding channel 5, a pressure of the fluid flow exceeds atmospheric pressure to a large extent because of the collision of the auxiliary fluids flowing thereagainst and, at the same time, the velocity of the fluid flow m flowing near the innermost wall of the guiding channel is increased because of the mingling of the flow of the auxiliary fluids with that of the fluids jetted from a main nozzle. Therefore, the escaping fluid flow n tends to be larger at the innermost wall thereof, as compared with the second embodiment.

However, inspite of the occurrence of a large amount of the escaping fluid flow n, the guide member type of jet loom comprising the auxiliary nozzles in addition as arranged above is advantageous in that the width of the fabric is flexibly increased as long as possible and that the flying speed of the weft can be increased with maintaining a good stability in the weft insertion because the weft is drawn near to the innermost wall of the guiding channel by the auxiliary fluids jetted from the auxiliary nozzle 32 and carried through the guiding channel by the mingled fluid flow m of high velocity.

The present invention is characterized in that a curved groove 35 as a cavity is formed and elongated along each of the openings 22 and 31 at the circumference thereof on a downstream side wall 36, in the direction of weft insertion, of the mutually facing side walls of the guide members 20 and 30. The curved groove 35 has a V-shape constituted by two inclined faces having different angles with respect to the side wall of the guide member 20 and 30; one inclined face of the curved groove 35 on the nearer side to the opening 22 and 31 intersects with the side wall of the guide member 20 and 30 at a small angle and the other inclined face thereof on the far side from the opening 22 and 31 intersects therewith at a large angle. In this embodiment shown in FIG. 5 and FIG. 6, the other inclined face of the curved groove 35 on the far side from the opening 22 and 31 intersects with the side wall of the guide member 20 and 30 at a right angle.

By means of the curved groove 35 formed on the downstream side wall 36, a vortex 25 is enlarged and strengthened to stabilize the size and the position of the vortex. Due to this stabilized formation of the vortex 25, the amount of the escaping fluid flow q is decreased by the reduction of the cross-sectional area effective for the fluid flow q to escape through the space between each two adjacent guide blades and the mingled fluid flow as shown by a line m is strengthened, with the result that the flying speed of the weft is further increased.

As the guide member in accordance with this embodiment functions for the reduction of the escaping fluid flow q, a jetting angle $\theta$ of the auxiliary nozzle 32 can be flexibly increased as large as possible and a large pushing force produced by dynamic pressure of fluids jetted from the auxiliary nozzle 32 acts on the weft, whereby the weft can be stably maintained, during its flight, near the innermost wall of the guiding channel.

In accordance with known type of the guide member, the increase of a jetting angle $\theta$ only leads to the disadvantageous increase of the escaping fluid flow n, not to the increase of the mingled fluid flow m. Therefore, although the weft can be prevented from getting out of a slit 21, the increase of the flying speed of the weft can be actualized.

On the other hand, according to this embodiment, as the increase of the jetting angle $\theta$ does not cause the reduction of the mingled fluid flow m, the flying speed of the weft can be increased with maintaining a good stability in the weft insertion.

In the embodiment shown in FIG. 5, the auxiliary nozzle is disposed separately from the guide member. This disposition of the auxiliary nozzle is convenient in that the adjustment of the auxiliary nozzle can be flexibly made, depending on the the kind of the weft. Alternatively, it is possible that the auxiliary nozzle can be combined with the guide member as in a known manner.

Referring now to FIG. 7 to FIG. 10, the effects of the present invention will be described hereinafter.

Figure 7:
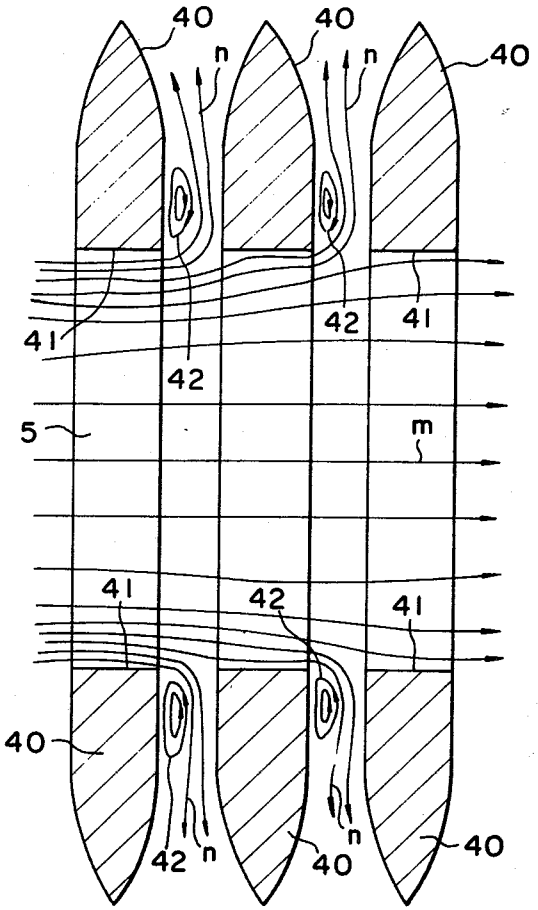
FIG. 7 is a cross-sectional view of a plurality of the prior art guide members by way of illustration of the effects in accordance with the present invention.

FIG. 7 is a cross-sectional view of a guiding channel formed by a plurality of known guide members taken across a substantially center line of the guiding channel and schematically shows the flow of fluids, particularly the air flow. The air flow jetted from a main nozzle into the guiding channel is gradually spreaded as the distance from the main nozzle increases, till at last, as shown in FIG. 7, the air flow is widely spreaded over the whole area of the guiding channel. Simultaneously, the air flow which flows near the wall of the opening 41 of the guide member 40, as shown by a line n, separates from the edge of the wall thereof and escapes through the space between each two adjacent guide members outside the guiding channel, while forming a vortex 42. The vortex 42 whirls in the direction shown by an arrow in FIG. 7 and the growth of the vortex leads to the increase of the resistance imparted to the escaping air flow.

Figure 8:
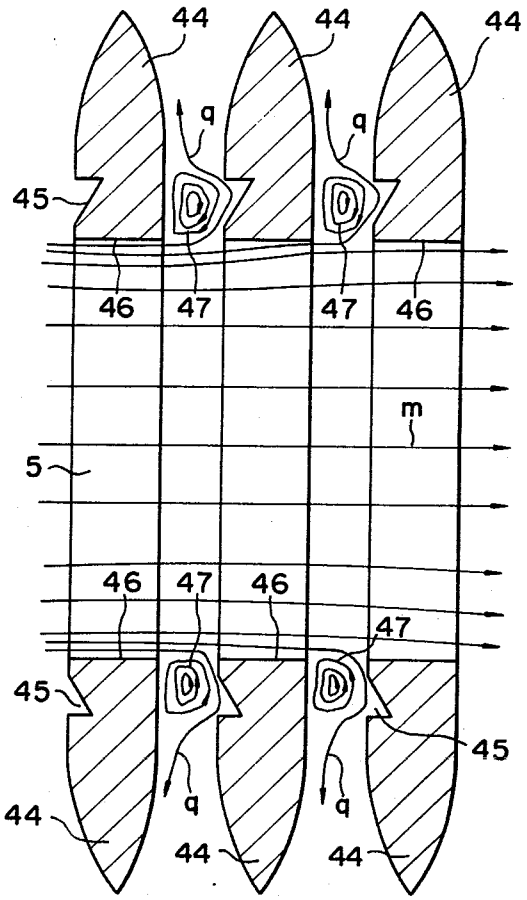
FIG. 8 is a cross-sectional, illustrative view of a plurality of the guide members emboding the present invention.

FIG. 8 is a cross-sectional view of a guiding channel formed by a plurality of guide members 44 in accordance with the present invention, taken across a center line of the guiding channel, and schematically shows the air flowing through the guiding channel, in the same manner as shown in FIG. 7. The guide member 44 having the same configuration as the guide member 40 is provided with a curved groove 45 as a cavity formed and elongated along each of the openings 46 at the circumference thereof on a downstream side wall, in the direction of weft insertion, of the mutually facing side walls of the guide members 44.

The curved groove 45 has a V-shape constituted by two inclined faces having different angles with respect to the side wall of the guide member 44; one inclined face of the curved groove 45 on the nearer side to the opening 46 intersects with the side wall of the guide member 44 at a small angle and the other inclined face thereof on the far side from the opening 46 intersects therewith at a large angle.

Even if the guide member 44 as described above is employed, it is inevitable, as observed in known guide member, that air flow m flowing through the guiding channel 5 escapes through the space between the mutually facing side walls of each two adjacent guide members 44, and, at the same time, separates from the edge of the wall of each of the openings 46 which form the guiding channel 5 to bring about the occurrence of a vortex 47.

However, the air flowing into the space between each two adjacent guide members 44 is introduced to flow along the curved groove 45, i.e., flow into the curved groove 45 along the face downwardly inclined at a small angle and flow out of the curved groove 45 along the face upwardly inclined at a large angle, whereby the resulting air flow is bended in the direction opposite to the air flow m. As a result, the intensity of the vortex 46 is strengthened and the size of the vortex 47 is enlarged to fix the position of the vortex 47 at the space between the curved groove 45 and the side wall of the guide member 44 facing the curved groove 45.

Due to the existence of the above-mentioned vortex, a cross-sectional area effective for the air flow to escape through the space between each two adjacent guide members 44 is narrowed; a resistance imparted to the escaping air flow is increased; and the escaping air flow is bended as shown by a line q to reduce the velocity thereof. This results in the reduction of the amount of the escaping air flow as shown by the arrow of the line q.

It goes without saying that it is effective to narrow the space between each two adjacent members for the purpose of reduction of the air flow escaping through the space therebetween. However, the guide member aims to function for the penetration of the warps through the space therebetween and for the formation of the guiding channel for the weft. Accordingly, in order to penetrate the warps therethrough in a smooth manner, it is impossible to reduce the space between each two adjacent guide members to the width less than a predetermined value. The present invention has been made so as to make it possible to reduce the escaping air flow, under the above-mentioned restrictions. If a curved groove is formed on an upstream side wall of the mutually facing side walls of each two adjacent guide members instead of a downstream side wall thereof as shown in FIG. 8, the air flow escaping through the space between the guide members is, similarly, bended complicatedly due to the formation of the curved groove to diminish the velocity of the escaping air flow, with the result that the amount of the escaping air flow is reduced.

Furthermore, the curved groove does not cause any damage to the warp penetrating through the space between the guide members and no accumulation of dust and flies is made due to the constant flow of the escaping air into the curved groove.

Figure 9:
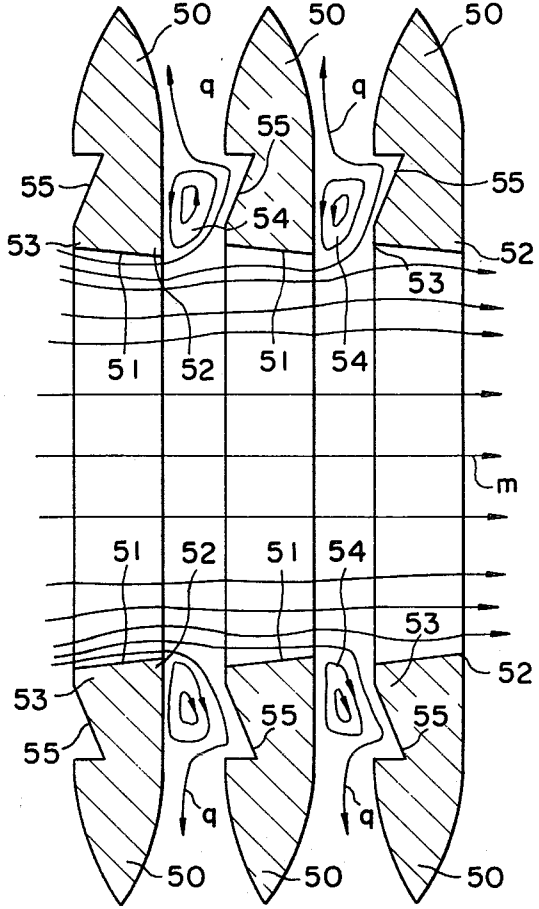
FIG. 9 is a cross-sectional, illustrative view of a plurality of another guide members emboding the present invention.

FIG. 9 is a cross-sectional view of a guiding channel formed by a plurality of guide members in accordance with the present invention taken across a center line thereof and schematically shows the air flowing through the guiding channel, in the same manner as shown in FIG. 7.

Referring to FIG. 9, the same guide member as shown in FIG. 8 is employed as the guide member 50 and is further provided with a tapered face on the wall 51 of the opening which is so defined that the edge 52 of a downstream side of the wall 51 of the opening is inclined nearer to the longitudinal axis of the guiding channel than the edge 53 of an upstream side thereof, in the direction of weft insertion.

It is known in the conventional guide member that the formation of the aforementioned tapered face on the wall of the opening has the effects in reduction of an escaping air flow. This reduction results from the fact that, by means of the wall 51 defined by a tapered face, the air flowing along the wall 51 is centrally directed to the longitudinal axis of the guiding channel 5, free from the collision against the edge 53 of the upstream side of the next guide member.

However, as a static pressure in the guiding channel 5 exceeds atmospheric pressure to a large extent, the escaping air flow inevitably exists and the existence of the escaping air flow cannot be neglected as mentioned in the description with reference to FIG. 7. Since the guide member 50 is provided with the same curved groove 55 as shown in FIG. 8 formed on a downstream side wall, in the direction of weft insertion, of the mutually facing side walls of the guide members, the size of the vortex is strengthened to fix the position of the vortex at the space between the curved groove 55 and the side wall of the guide member 50 facing the curved groove 55.

Due to the formation of the above-mentioned vortex, the cross-sectional area effective for the air flow to escape through the space between each two adjacent guide members is narrowed; a resistance imparted to the escaping air flow is increased; and the escaping air flow is bended as shown by a line q to reduce the amount of the escaping air flow, as mentioned in the description with reference to FIG. 8.

In order to confirm the effects in accordance with the present invention, the following experiments were conducted. Firstly, 100 Nl/min. of the air was jetted from a main nozzle having an outlet of the inside diameter $\phi_3$. Then, the air velocity was measured with a Pitot tube at several points spaced at predetermined distances from the main nozzle in the direction of weft insertion.

Figure 10:
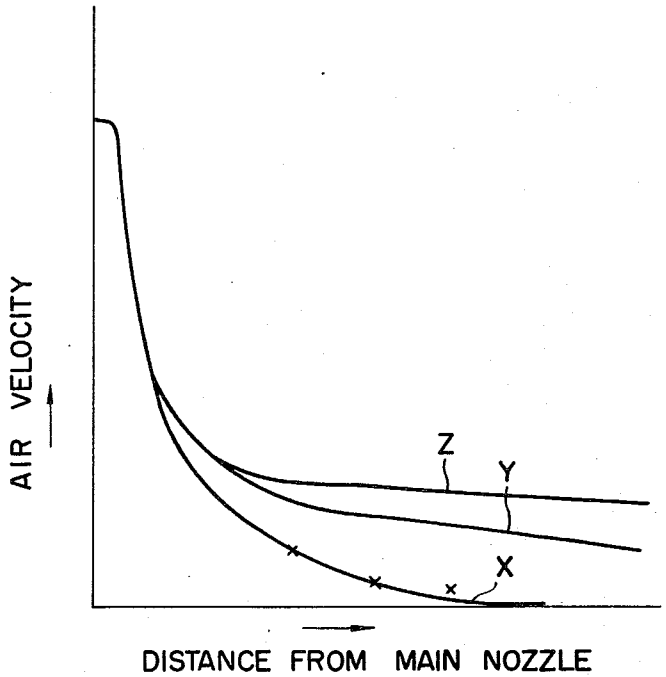
FIG. 10 is a graph illustrating the relationship between the velocity of the air jetted from a main nozzle and the distance from the main nozzle in one embodiment of the present invention.

The experimental result shows that the air velocity is rapidly diminished as the distance from the main nozzle increases, as is apparent from the line X indicated in FIG. 10.

Next, the conventional guide members as shown in FIG. 7, which has 2 mm in thickness and is provided with a substantially circular shaped opening of 10 mm in the inside diameter, were arranged in alignment at a space of 1 mm over the length of 400 mm. Then, 100 Nl/min. of the air from the main nozzle was jetted into the guiding channel and the air velocity was measured. As is apparent from the line Y shown in FIG. 10, a rise in the air velocity was recognized at the point at a relatively long distance from the main nozzle.

Additionally, the same guide members in size as the aforesaid guide member provided with a curved groove along each of the openings at the circumference thereof on a downstream side wall, in the direction of weft insertion, of the mutually facing side walls of the guide members were arranged in alignment at a space of 1 mm over the length of 400 mm. Similarly, 100 Nl/min. of the air was jetted into the guiding channel and the air velocity was measured with a Pitot tube in the same manner as above. As is apparent from the line Z shown in FIG. 10, the decline in the air velocity was scarcely recognized on the downstream area from the point at a predetermined distance from the main nozzle in the guiding channel.

It has been confirmed from the aforementioned experiments that the reduction of the escaping air flow in accordance with the present invention is remarkably effected in the downstream area of the guiding channel. As shown by the respective lines X, Y and Z in FIG. 10, no difference in the air velocity is made at any point in the guiding channel formed by the guide members which are aligned within the distance of 50 mm from the main nozzle.

As the reason for this phenomena, it is considered that, within the aforementioned distance, the air jetted from the main nozzle is not yet spreaded toward the wall of the guiding channel, so that no air flow is flowing against or along the wall thereof. On the contrary, the additional phenomena has been observed that the air from the outside is sucked into the guiding channel through the space between each two adjacent guide members. Therefore, under these circumstances, it has been confirmed that the effects due to the formation of the curved groove characterized by the present invention cannot be produced.

As a result, it has been proved that it is not necessary to form a curved groove along each of the openings of the guide members which constitute a guiding channel within the distance of 50 mm from a main nozzle, from the viewpoint of the practical application.

Figure 11:
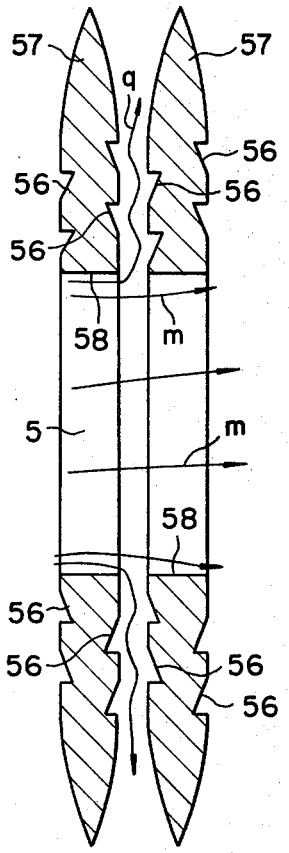
FIG. 11 and FIG. 12 are the respective cross-sectional views of the modified embodiments of the guide members in accordance with the present invention.
Figure 12:
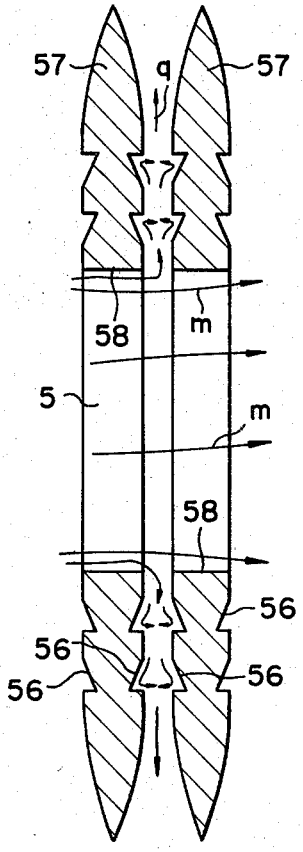

FIG. 11 and FIG. 12 show other embodiments of the present invention applied to the guide member type of an apparatus for the weft insertion in a jet loom. In these embodiments, at least one curved groove 56 as a cavity is formed and elongated along each of the openings 58 at the circumference thereof on an upstream side wall and a downstream side wall, respectively, in the direction of weft insertion, of the mutually facing side walls of the guide members 57.

In the embodiment shown in FIG. 11, the curved groove 56 formed on the upstream side wall of the mutually facing side walls of the guide members and the curved groove 56 formed on the downstream side wall thereof are respectively positioned at different distances from the wall of each of the openings 58.

On the other hand, in the embodiment shown in FIG. 12, the curved grooves 56 formed on both side walls of the mutually facing side walls of the guide members 57 are positioned at the equal distance from the wall of each of the openings 58.

In addition to the effects described in the embodiments shown in FIG. 8 and FIG. 9, more remarkable effects are exhibited that a resistance imparted to the fluid flow passing through the space between each two adjacent guide members is increased by complicating a passage for the fluid flow to escape due to the formation of the curved grooves in the above-described position on both side walls of the mutually facing side walls of the guide members and the escaping fluid flow is more complicatedly bended to diminish the velocity of the escaping fluid flow, with the result that the amount of the escaping fluid flow is still further reduced.

However, the disadvantages of the guide member type of jet loom shown in this embodiment reside in that the size of the guide member is inevitably enlarged and that the area of the guide member brought into the contact with the warp is increased, so that the chance of causing a damage to the warp, such as the occurrence of a fuzz, is increased. For this reason, it is preferable that this type of the guide member shown in FIG. 11 and FIG. 12 is applied to a jet loom for weaving the fabric having a rough density of the warp.

Figure 13:
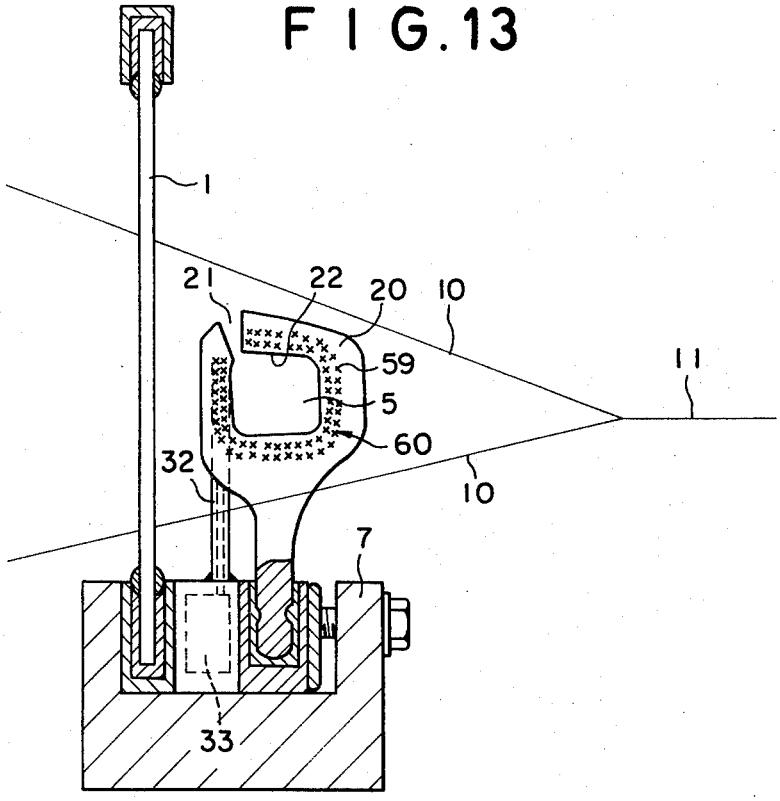
FIG. 13 is a side elevation of another modified embodiment of the guide members in accordance with the present invention.
Figure 14:
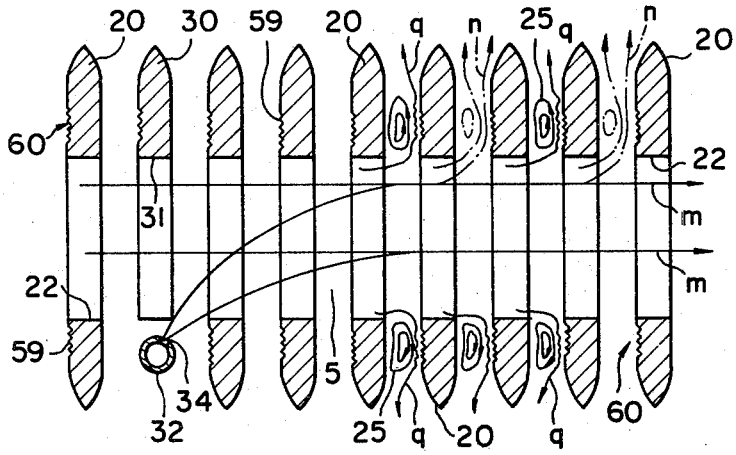
FIG. 14 is an enlarged, cross-sectional view of the principal part of the same embodiment as shown in FIG. 13.

FIG. 13 and FIG. 14 show a modified embodiment of the present invention applied to a guide member type of apparatus for the weft insertion in a jet loom. In this embodiment, each of the guide members 20 and 31 are provided with an indented, coarse face 60, defined by a plurality of dimples as a cavity which are formed and dotted in an indefinite direction, i.e., at random, along each of the openings 22 and 31 at the circumference thereof on a downstream side wall, in the direction of weft insertion, of the mutually facing side walls of the guide members 20 and 30.

In accordance with this modified embodiment shown in FIG. 13 and FIG. 14, the same effects as described in the above-mentioned embodiments can be obtained. Namely, the escaping fluid flow q is introduced to flow along the indented, coarse face 60 defined by a plurality of dimples, whereby the size of a vortex 25 is enlarged and the intensity thereof is strengthened to stabilize the size and the position of the vortex 25. Due to the stabilized formation of the enlarged and strengthened vortex, a cross-sectional area effective for the fluid flow to escape through the space between each two adjacent guide members is narrowed; a resistance imparted to the fluid flow passing through the space therebetween is increased; and the velocity of the escaping fluid flow as shown by a line q is diminished. As a result, the flying speed of the weft can be increased with maintaining a good stability in the weft insertion.

Numerous other modifications and variations of the present invention may be made without departing from the spirit and scope of the present invention. Accordingly, it is to be understood that the present invention is not to be limited to the disclosed embodiments thereof.

What is claimed is:

1. In an apparatus for inserting a weft into a shed by jetting fluids in a jet loom comprising a plurality of thin plate-like members arranged in alignment in the direction of weft insertion on a sley, each of said thin plate-like members being provided with an opening in the same position of each of said thin plate-like members to form a guiding channel, and nozzle means for jetting fluids through said guiding channel, an improvement wherein substantially all of said thin plate-like members consist essentially of elements forming said opening and having cavity means for strengthening and stabilizing a vortex in said fluid between said element and an adjacent plate-like member to substantially reduce the escape of fluid between said element and said adjacent plate-like member, said cavity means comprising a cavity around the periphery of an adjacent said opening on a downstream, in the direction of weft insertion, sidewall of two mutually facing sidewalls of said element and said adjacent plate-like member.

2. The apparatus for inserting a weft into a shed by jetting fluids in a jet loom according to claim 1, wherein at least one said cavity is formed on each of an upstream side wall and a downstream side wall, in the direction of weft insertion, of the mutually facing side walls of two adjacent thin plate-like members.

3. The apparatus for inserting a weft into a shed by jetting fluids in a jet loom according to claim 2, wherein at least one said cavity formed on said upstream side wall and at least one said cavity formed on said downstream side wall are positioned equal distances from the wall of each of said openings.

4. The apparatus for inserting a weft into a shed by jetting fluids in a jet loom according to claim 1, wherein at least one said cavity comprises a curved groove formed and elongated along each of said openings of said thin plate-like members at the circumference thereof.

5. The apparatus for inserting a weft into a shed by jetting fluids in a jet loom according to claim 4, wherein said curved groove has a V-shape constituted by two inclined faces having different angles with respect to the side wall of said thin plate-like member:

one inclined face of said curved groove on the nearer side to said opening intersecting with the side wall at a small angle and the other inclined face thereof on the far side from said opening intersecting therewith at a large angle.

6. The apparatus for inserting a weft into a shed by jetting fluids in a jet loom according to claim 5, wherein the other inclined face of said curved groove on the far side from said opening intersects with the side wall of said thin plate-like member at a right angle.

7. The apparatus for inserting a weft into a shed by jetting fluids in a jet loom according to claim 1, wherein said thin plate-like members comprise reed blades of a reed, each of said reed blades being provided with an opening in the same position of each of said reed blades to form a guiding channel.

8. The apparatus for inserting a weft into a shed by jetting fluids in a jet loom according to claim 1, wherein said thin plate-like members comprises a plurality of guide members arranged in alignment in the direction of weft insertion, independently of a reed, on a sley, each of said guide members being provided with an opening in the same position of each of said guide members to form a guiding channel.

9. The apparatus for inserting a weft into a shed by jetting fluids in a jet loom according to claim 1, wherein each of said thin plate-like members is provided with a tapered face on the wall of each of said openings, said tapered face being so defined that the edge of a downstream side of the wall of each of said openings is inclined nearer to the longitudinal axis of said guiding channel than the edge of an upstream side thereof in the direction of weft insertinon.

10. The apparatus for inserting a weft into a shed by jetting fluids in a jet loom according to claim 1, wherein said nozzle means comprises a plurality of auxiliary nozzles arranged at a predetermined space in alignment with said thin plate-like members on a sley, each of said auxiliary nozzles confronting each one of a predetermined number of said thin plate-like members.

11. The apparatus for inserting a weft into a shed by jetting fluids in a jet loom according to claim 10, wherein at least one said cavity is formed on said thin plate-like members which constitute a downstream area from a point at a predetermined distance from a nozzle of said guiding channel.

12. Apparatus according to claim 1 wherein said cavity is formed by two inclined faces forming different angles with respect to said downstream sidewall, one inclined face of said cavity being nearer said opening and forming an acute angle with said downstream sidewall and the other of said inclined faces being perpendicular to said downstream side wall.

13. In an apparatus for inserting a weft into a shed by jetting fluids in a jet loom comprising a plurality of thin plate-like members arranged in alignment in the direction of weft insertion on a sley, each of said thin plate-like members being provided with an opening in the same position of each of said thin plate-like members to form a guiding channel, and nozzle means for jetting fluids through said guiding channel, an improvement comprising at least one cavity around the circumference of said opening of at least one of said thin plate-like members on one side wall of two mutually facing side walls of adjacent thin plate-like members, said one side wall being downstream, in the direction of weft insertion, of the other of said two mutually facing side walls, wherein at least one said cavity is formed on each of an upstream side wall and a downstream side wall, in the direction of said weft insertion, of the mutually facing side walls of two adjacent thin plate-like members, and at least one said cavity formed on said upstream side wall and at least one said cavity formed on said downstream side wall are respectively positioned at different distances from the wall of each of said openings.

14. In an apparatus for inserting a weft into a shed by jetting fluids in a jet loom comprising a plurality of thin plate-like members arranged in alignment in the direction of weft insertion on a sley, each of said thin plate-like members being provided with an opening in the same position of each of said thin plate-like members to form a guiding channel, and nozzle means for jetting fluids through said guiding channel, an improvement comprising at least one cavity around the circumference of said opening of at least one of said thin plate-like members on one side wall of two mutually facing side walls of adjacent thin plate-like members, said one side wall being downstream, in the direction of weft insertion, of the other of said two mutually facing side walls wherein at least one said cavity is formed along each of said openings of said thin plate-like members, and at least one said cavity comprises a plurality of curved grooves formed and elongated in parallel along each of said openings of said plate-like members at the circumference thereof.

15. In an apparatus for inserting a weft into a shed by jetting fluids in a jet loom comprising a plurality of thin plate-like members arranged in alignment in the direction of weft insertion on a sley, each of said thin plate-like members being provided with an opening in the same position of each of said thin plate-like members to form a guiding channel, and nozzle means for jetting fluids through said guiding channel, an improvement comprising at least one cavity around the circumference of said opening of at least one of said thin plate-like members on one side wall of two mutually facing side walls of adjacent thin plate-like members, said one side wall being downstream, in the direction of weft insertion, of the other of said two mutually facing side walls wherein at least one said cavity is formed along each of said openings of said thin plate-like members, and at least one said cavity comprises a plurality of dimples formed and dotted along each of said openings of said thin plate-like members at the circumference thereof.

16. In an apparatus for inserting a weft into a shed by jetting fluids in a jet loom comprising a plurality of thin plate-like members arranged in alignment in the direction of weft insertion on a sley, each of said thin plate-like members being provided with an opening in the same position of each of said thin plate-like members to form a guiding channel, and nozzle means for jetting fluids through said guiding channel, an improvement comprising each of said thin plate-like members provided with at least one cavity which is formed at the circumference of each of said openings of said thin plate-like members on at least one side wall of the mutually facing side walls of each two adjacent thin plate-like members wherein at least one said cavity comprises a plurality of dimples formed and dotted along each of said openings of said thin plate-like members at the circumference thereof.

17. A method of substantially reducing the escape of jetting fluids between adjacent thin plate-like members in a jet loom, each of said plate-like members having an opening for forming a guiding channel, comprising the steps of directing a jetting fluid through said channel with a portion of said fluid leaking out of said channel between said adjacent plate-like members and forming a vortex, and strengthening and stabilizing said vortex in said portion of said fluid by providing a cavity adjacent said opening on a downstream sidewall of two mutually facing sidewalls of said adjacent plate-like members.

* * * * *

UNITED STATES PATENT AND TRADEMARK OFFICE

CERTIFICATE OF CORRECTION

PATENT NO. : 4,458,732

DATED : July 10, 1984

INVENTOR(S) : Kazunori Yoshida, Susumu Kawabata, Fuzio Suzuki, and Yoshikatsu Kisanuki It is certified that error appears in the above-identified patent and that said Letters Patent are hereby corrected as shown below:

On the title page Insert:

-- [30] Foreign Application Priority Data

July 28, 1980 [JP] Japan ..... 55-103380 --

Column 12, line 47, change "an" to -- and --.

Signed and Sealed this

Seventh Day of May 1985

[SEAL]

*Attest:*

DONALD J. QUIGG

*Attesting Officer* *Acting Commissioner of Patents and Trademarks*